United States Patent [19]

Yandle, II

[11] Patent Number: 4,840,192

[45] Date of Patent: Jun. 20, 1989

[54] HYDRAULIC HAMMER REDUCTION SYSTEM FOR RAILROAD TANK CARS

[76] Inventor: Sylvester E. Yandle, II, c/o Industrial Pump Sales, Inc., 2814 Engineers Rd., Belle Chasse, La. 70037

[21] Appl. No.: 859,791

[22] Filed: May 5, 1986

[51] Int. Cl.[4] ..... F16K 17/40

[52] U.S. Cl. ..... 137/681; 137/347; 137/590

[58] Field of Search ..... 137/350, 587, 589, 347, 137/590, 68.1; 220/86 R; 105/358; 251/127; 138/42

[56] References Cited

U.S. PATENT DOCUMENTS

| | | | |
|---|---|---|---|
| 630,315 | 8/1899 | Barclay | 138/42 X |
| 1,144,306 | 6/1915 | Mock | 251/127 X |
| 2,247,566 | 7/1941 | Walton | 137/254 |
| 2,827,071 | 3/1958 | Patterson | 137/254 |
| 4,347,863 | 9/1982 | Keyes | 137/587 X |

*Primary Examiner*—A. Michael Chambers
*Assistant Examiner*—John C. Fox
*Attorney, Agent, or Firm*—Pravel, Gambrell, Hewitt, Kimball & Krieger

[57] ABSTRACT

A mechanical hydraulic dampening device having kinetic energy dissipating baffles in its interior with no moving parts, which device is included in a moving tank car carrying a liquid load, such as for example a railroad tank car, having a rupture disk assembly at the top of the tank to prevent fracturing of the tank due to hydraulic hammer action, the device being located in line between the rupture disk and the liquid load. When the tank is suddenly moved, the shifting liquid load passes through the pipe-like device, impacting against a series of longitudinally spaced, opposed, diverging, upwardly angled, flat plates each extending across more than 50% of the interior of the pipe body of the device, causing its energy and the hydraulic hammer action to be dissipated. In most, if not all, cases the presence of the mechanical baffling device prevents the rupture disk from rupturing, while maintaining the hydraulic hammer action down to acceptable limits, preventing spilling of any of the liquid load which otherwise would have occurred through the rupture disk. The device is relatively small, occupying and extending into far less than 1% of the total tank capacity.

12 Claims, 3 Drawing Sheets

HYDRAULIC HAMMER REDUCTION SYSTEM FOR RAILROAD TANK CARS

BACKGROUND OF THE INVENTION

1.Field of the Invention

The present invention relates to a kinetic liquid energy reduction system for reducing the level of hydraulic hammer, and more particularly to such a system for use in tank vehicles transporting liquids such as for example railroad tank cars, and even more particularly to such a system wherein a baffling, energy dissipation device having a series of alternating, angled plates in the interior of a pipe-like body is utilized in combination with a rupture disk or plate in order to diminish the potentially disastrous effects of hydraulic hammer action. This is a phenomenon which occurs when for example a railroad tank car loaded with liquid becomes subjected to an abrupt increase or decrease in speed, and which, if unchecked, may cause a catastrophic failure or fracture of the tank.

2. Prior Art & General Background

Moving vehicles carrying a liquid load in a tank, such as for example railroad tank cars, when carrying liquids, must cope with problems associated with hydraulic hammer action, a phenomenon which occurs when a liquid in a confined area is subjected to an abrupt increase or decrease in speed.

The resulting kinetic energy produced by the moving liquid inside the container (in the case of a railroad tank car) must either:

(1) be released in some manner from the container; or (2) be absorbed by some device other than the container itself.

The railroad tank car, which typically has a tank capacity of twelve to fifteen thousand gallons, is often unable to absorb the resulting kinetic liquid energy caused by hydraulic hammer action, and, unless some means is employed whereby the energy is diminished or released from the unit, the tank car itself will fracture, causing destruction of the tank and the loss of the load to the ambient, which in the case of for example toxic chemicals can be an environmental disaster.

The considerable expenses and dangers which could result from hydraulic hammer action in railroad tank cars include catastrophic unit failure, which would occur if the tank fractured to such an extent so as to render it irreparable, or, in a lesser case, simple fracture, a fracture of repairable proportions. However, both types of fractures could result in a spill of varying degrees, including the possible release of toxic liquids and gases into the atmosphere and the surrounding areas, and the considerable expense and danger associated with clean up and repair.

In attempting to deal with the problems associated with hydraulic hammer action in for example railroad tank cars, the railroads and associated carriers have traditionally employed the first method of dealing with the resulting kinetic liquid energy, that is, allowing excess energy to escape from the tank car itself before the greater damage of tank failure could occur. In order for the energy to escape (which was in the kinetic form of the movement of the liquid mass), a rupture disk and an associated liquid escape system was affixed to the top of the tank car.

This prior art liquid escape system is effectively a relief drain which allows a relatively small amount or part of the total liquid load to escape into the atmosphere and surrounding area, thereby relieving he excessive pressure.

The rupture disk is a wafer type disc which, under normal conditions, would seal the contents of the tank from the relief drain, thereby preventing the contents from escaping. However, under conditions of severe pressure, such as those caused by hydraulic hammer action, the rupture disk ruptures, allowing the liquid to pass to the relief drain and out of the tank, thus releasing the excessive pressure and saving the tank and the balance of the liquid load.

A problem associated with the rupture disk system, however, is that when a disk ruptures a replacement rupture disk must be installed, entailing considerable time delay and expense. An additional and potentially more dangerous and damaging problem associated with the rupture disk system is that it is likely that a least a minor spill of the contents of the tank would have occurred in the release of the pressure, thereby contaminating the atmosphere or surrounding area. Such environmental spill or contamination has resulted in a rash of litigation and substantial expense.

The rationale in utilizing such a system was that it was better to incur the relatively minor expense and danger associated with disk replacement and a minor spill than to have incurred the extensive expense and danger of tank car fracture and/or a major spill. However, as indicated, this has been far from a satisfactory solution and situation.

3. General, Summary Discussion of the Invention

The present invention in its preferred embodiment is designed to diminish excessive levels of kinetic liquid energy, generally not allowing the liquid to escape, as with the rupture disk system, but by absorbing the excess kinetic liquid energy, thereby avoiding damage to the tank and preventing in most, if not all cases, even minor spills.

The present invention in its preferred embodiment utilizes a system of opposed, extended baffles included in a relatively small size pipe leading to the standard rupture disk. The dampening baffle system of the present invention, when used in for example a railroad car, occupies and is located in far less than one percent of the total tank area, which tank area typically has a capacity of twelve to fifteen thousand gallons. This is of course far different in structure and approach from the known use of relatively large anti-slosh plates positioned throughout a tank to prevent substantial movements or surges of liquids in storage tanks.

The dampening, energy dissipating baffles are for example formed by a series of alternating, angled plates positioned in succession up the relatively small diameter pipe in order to diminish the kinetic energy of the liquid cargo as it flows up the pipe. As the present invention is designed to diminish the effects of hydraulic hammer action, it has been referred to as an "hydraulic damper" (trademark "Hydro-Damp").

The preferred embodiment of the present invention is designed to work in conjunction with the standard rupture disk system, in such a manner as to allow the rupture disk system to serve only as a final "fail-safe" relief system, in the event that the hydraulic hammer action becomes so excessive so as to render even the present invention ineffectual. Thus, the rupture disk system would go into effect only as a very last resort, thereby averting premature disk failures and cargo spills in most, if not all, cases, while maintaining the integrity of the railroad tank car.

The system of the present invention is thus a safer, less expensive and less time consuming system in its maintenance, which protects the environment and the tank car as well from the excessive pressures associated with hydraulic hammer action in a moving vehicle carrying a liquid load in a tank.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 2:
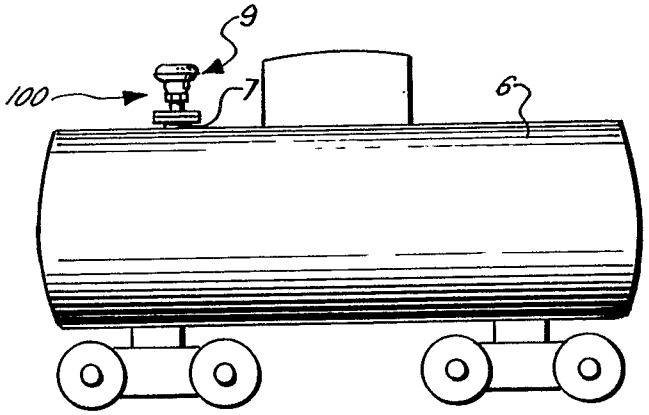
FIG. 2 is a side view of an exemplary, standard railroad tank car showing the preferred, general location of the hydraulic hammer reduction system of the present invention adjacent and leading to the standard rupture disk system of the tank car.

The preferred, exemplary application of the hydraulic hammer reduction system of the present invention is railroad tank cars, an exemplary one of which is illustrated in FIG. 2. As can be seen in that figure, a rupture disk assembly 9 is included as a standard item leading into the tank 6 of the railroad car.

Figure 1:
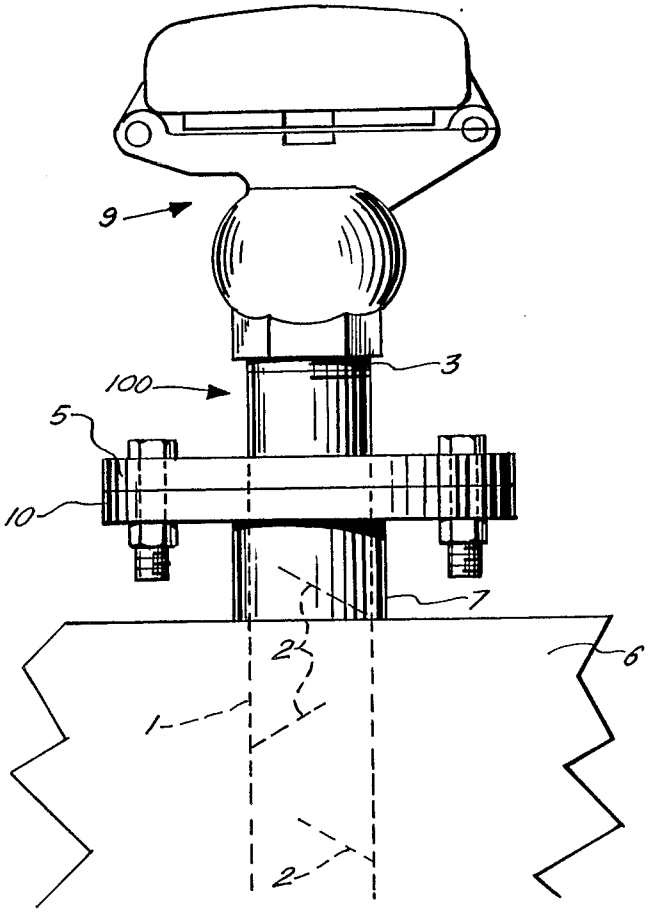
FIG. 1 is a side, partial view of the hydraulic hammer reduction system of the present invention illustrated primarily in phantom line, showing the preferred embodiment of the baffling device of the present invention located below and leading into the standard rupture disk assembly included on the standard railroad tank car, such as for example that which is illustrated in FIG. 2.

As is known, the standard rupture disk assembly 9, such as that illustrated in FIGS. 1 & 2, is a safety device which allows a relatively small amount of the liquid load to escape by rupturing the disk in the disk assembly 9, when there is a surge in the liquid load, as for example when the tank car is brought to a sudden stop. This allows part of the cargo to escape in order to save the tank itself from rupturing, causing the possible escape of the entire load, possibly greatly endangering the environment.

Figure 3:
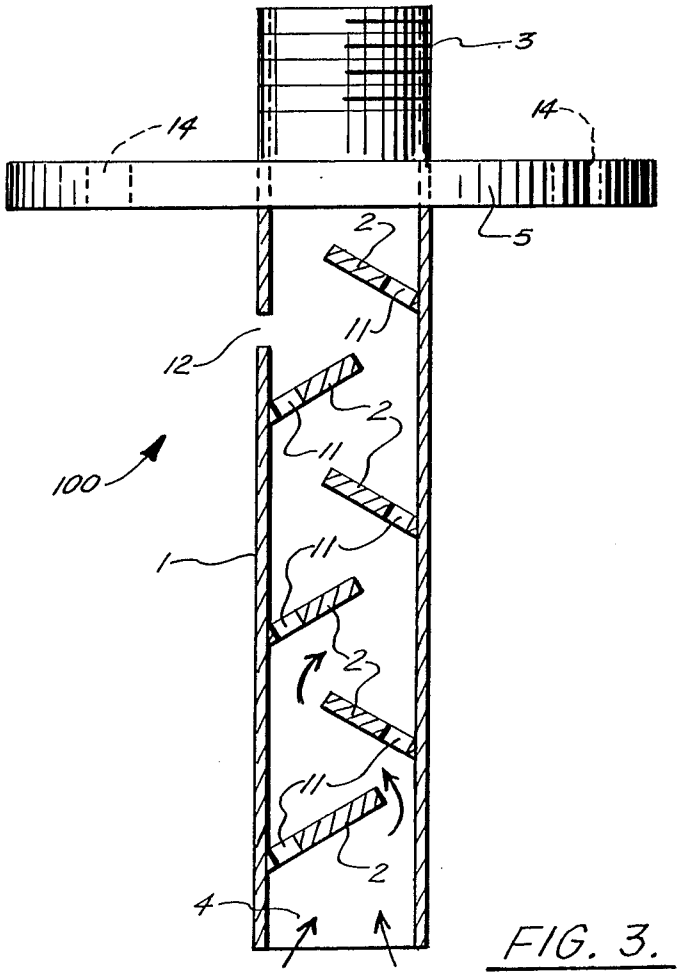
FIG. 3 is a side, mostly cross-sectional view of the preferred, exemplary embodiment of FIG. 1, illustrating the liquid flow with directional arrows.

As is best shown in FIGS. 1 & 3, the preferred, exemplary embodiment of the hydraulic hammer reduction damper 100 of the present invention includes a flange 5 for connecting it to the like plate or flange 10 of the standard nozzle attachment 7 provided for the rupture disc assembly 9 (as shown in FIG. 2). The flange plates 5, 10 are comprised of flat, circular plates directly or indirectly attached to and extending around but not blocking the top opening of the cylinder or basic pipe-body 1 of the damper 100.

The cylinder or pipe body of the damper body 1 in the exemplary embodiment illustrated extends two inches above the flange 5 and ten inches below the flange 5. A pressure relief or vacuum-break port 12 is located one and one-half ($1\frac{1}{2}$) inches below the flange 5.

Figure 5:
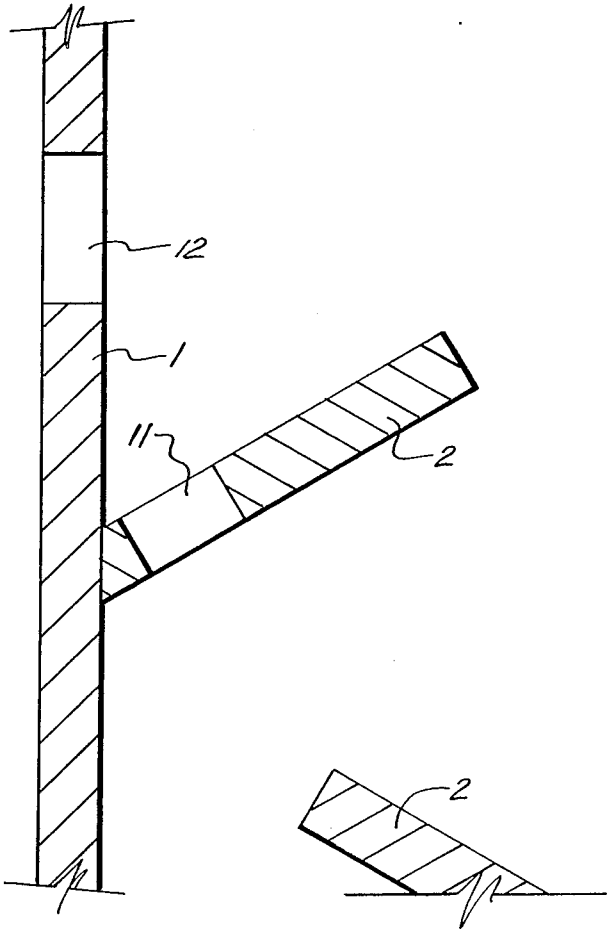
FIG. 5 is an enlarged or detail, partial, side cross-sectional view of a side portion of the embodiment of FIGS. 1 & 3, illustrating in detail the placement and relative scale of the cylinder wall, baffles, baffle drain holes, and vent relief or vacuum-break hole of the preferred, exemplary embodiment.

The interior of the cylindrical pipe body 1 has affixed to it a succession or series of upwardly directed, flat baffle plates 2 on both sides, constructed of stainless steel or some other suitable material, each separately welded into place at for example a thirty (30) degree angle up from the horizontal. Each baffle 2 has a drain hole 11 at its lowest point (note FIGS. 3, 5 & 6). Each energy dissipation or baffle plate 2 can be made of quarter inch plate spaced one and a half inches ($1\frac{1}{2}''$) apart on opposite sides of the body 1.

Figure 4:
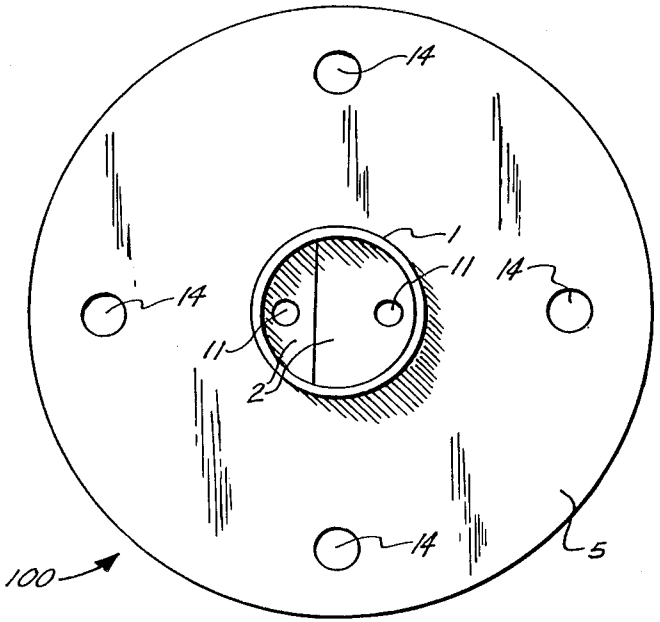
FIG. 4 is a top view of the preferred, exemplary embodiment of FIG. 3, showing its top portion.
Figure 6:
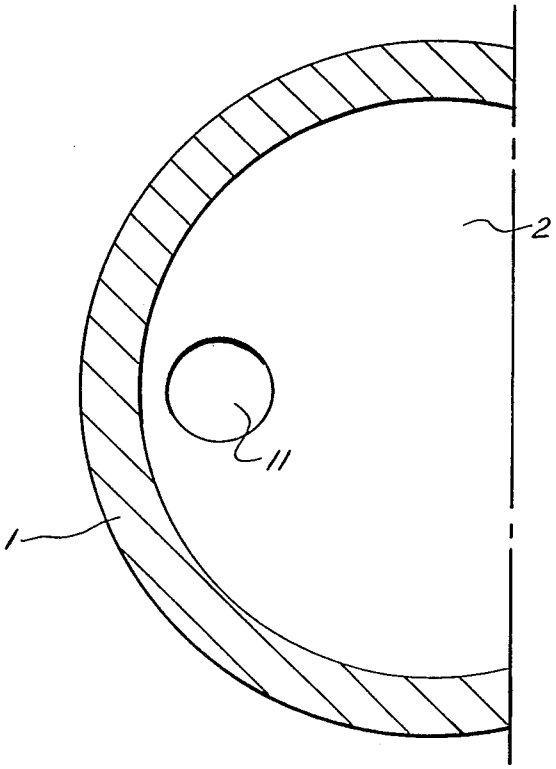
FIG. 6 is an enlarged, plan, partial, cross-sectional view illustrating from above one of the baffle plates of the preferred, exemplary embodiment of FIGS. 1 & 3.

As can best be seen in FIGS. 3, 4 & 6, each baffle plate 2 preferably extends past the center or axis line of the cylindrical pipe body 1, covering more than half of the horizontal cross-section of the body 1. With an exemplary diameter of two and three-eighths inches ($2\frac{3}{8}''$) for the pipe body 1, the baffle plates 2 may extend out horizontally one and a quater inches ($1\frac{1}{4}''$).

As illustrated in FIG. 3, exterior male threads 3 are included on the open, upper end of the cylinder 1, that is, the end closer to the flange plate 5, to which is screwed the standard rupture disc assembly 9 (note FIG. 1). The lower end 4 of the cylinder 1, or the end further from the flange plate 5, is likewise open and unobstructed.

When the damper 100 extends down into the tank 6 of the railroad car nine inches (9") with a cylindrical body having a diameter of two and three-eighths inches ($2\frac{3}{8}''$) it occupies only approximately forty cubic inches (40 cu.") of space in the tank 6, which typically has a capacity of twelve to fifteen thousand gallons (12,000–15,000 gals.). The device 100 thus occupies less than one quarter of a gallon, which of course is far less than one percent (1%) of the total volume, indeed minuscule.

The measurements, materials, and angles noted above are based on the present test embodiment, and of course may vary substantially depending upon the application and future design refinements.

Operation of Over-all System

As is best shown in FIG. 1, the flange 5 of the damper 100 is secured to the flange 10 of the tank car 6 by way of four (4) nuts and bolts using the flange bolt holes 14 and a gasket (not illustrated), creating an air tight seal. The threaded portion 3 of the damper 100 extends up and out of the tank car 6, while the opposite open end 4 of the cylinder 1 projects into the tank car 6, the body 1 being nested within and carried by the standard nozzle 7 of the rupture disk system. Screwed onto the threads 3 of the "Hydro Damp"(trademark) damper 100 is the rupture disk assembly 9.

When the motion of a tank car 6 is increased or decreased abruptly, hydraulic hammer pressure is created, a force whereby the liquid inside the tank car begins to release substantial kinetic energy. The liquid at this point enters the open, lower end 4 of the hydraulic damper 100.

As is best shown in FIG. 3, the liquid, after entering the opening 4, encounters the energy dissipating baffles 2, and is thereby diverted from one side of the cylinder 1 to the other (note direction arrows of Figure 3), while still being allowed to pass upwardly through the length of the damper 100 with sufficient speed to prevent tank fracture pressures from occurring. Each time the liquid encounters a baffle plate 2 and is diverted from one baffle 2 to another, the kinetic energy of the liquid is diminished or dissipated. The pressure relief port or vacuum-break 12 allows the air initially in the cylinder 1 to be relieved or moved into the top of the tank car 6 as the liquid displaces it in its upward journey.

Ideally, by the time the liquid reaches the upper end of the hydraulic damper 100, the pressure or kinetic energy of the liquid is diminished to a pressure below the working or breaking pressure of the rupture disk of the assembly 9, preventing its rupture. If the pressure is reduced sufficiently, the liquid will then drain back into the tank via the drain holes 11.

On the other hand, if the pressure or kinetic energy of the liquid is not reached sufficiently, that is, the pressure is still great enough to fracture the rupture disk of the assembly 9 after having passed through the damper 100, it will rupture, allowing the escape of a portion of the liquid load and relieving the excess pressure before fracturing of the tank 6 itself occurs. Thus, the ultimate fail-safe aspects of the rupture disk assembly 9 are still maintained with the present invention.

However, the presence of the damper 100 prevents rupturing of the disk in most, if not all cases, at least usually preventing the escape of any of the liquid load, which otherwise would have occurred, preventing any loss of the load and any damage to the environment.

The kinetic energy of the moving liquid load can be mechnically dissipated by many other forms and configurations of the damper of the present invention. Although the particular configuration and structure disclosed and illustrated is reliable, relatively easy to manufacture and economical, other shapes, sizes and configurations are of course possible. For example, the flow path can be made even more convoluted, openings or grates could be included, roughened surfaces or protrusions provided, varying size and configurations in cross-sections could be used as the damper is traversed, etc.

Additionally, the preferred application of the present invention is railroad tank cars, tank trucks, or other liquid load carriers and the like, in which a liquid load is being transported from one point to another in a tank, subject to abrupt changes in speed. However, the principles of the present invention can be applied to other applications, such as, for further example, a vertical turbine pump prior to or in place of a mechanical seal, etc.

Thus, the embodiment(s) described herein in detail for exemplary purposes are of course subject to many different variations in structure, design and application. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A mechanical energy dissipation system for dissipating hydraulic hammer action in a moving tank containing a liquid load of thousands of gallons in capacity, such as for example a railroad tank car or the like, having a rupture disk assembly located above a flange connection extending from the top of the tank into the interior of the tank for allowing some of the liquid load to escape from the tank when the liquid pressure exceeds the rupture point of the rupture disk of the disk assembly before the tank is fractured from the hydraulic hammer action, comprising:

a longitudingally extended mechanical device of a relatively small size in comparison to the size of the tank, said device having top flange connection means at its top area for connecting the device to the flange connection located at the top of the tank and for positioning its lower longitudinal end down into the tank in the area of the tank in which liquid would be present in a full tank and to position its other, upper longitudinal end in communication with the underside of the rupture disk being located in the line of flow between the rupture disk of the rupture disk assembly and the liquid load in the tank, said device in its interior between its lower longitudinal end and its top flange connection means presenting a series of diverging, energy dissipating impact surfaces to the liquid flow from the tank to the rupture disk, significantly dissipating the hydraulic hammer action of the liquid from the impact of the liquid against the impact surfaces as it flows through said device before its encounters the rupture disk, the size, placement and configuration of said device, said impact surfaces and its top flange connection providing kinetic energy dissipation means for causing said device to allow flow of the liquid from the tank to the rupture disk through the interior of said device in a way to significantly dissipate the kinetic energy generated by the hydraulic hammer caused by the sudden movement of thousands of gallons of liquid in the tank as part of the liquid moves through said device on its way to the rupture disk.

2. The system of claim 1, wherein said lower longitudinal end extends down into the interior of the tank and said device occupies less than and extends into less than about one percent (1%) of the interior volume of the tank.

3. The system of claim 1, wherein said device includes a cylindrical body; and said diverging, impact surfaces comprise:

a series of baffles in succession affixed to and longitudinally spaced along opposite sides of the interior of said cylindrical body, said cylindrical body projecting into the tank car and out of the tank car leading to the rupture disk assembly.

4. The system of claim 3, wherein said baffles are a series of flat plates affixed to the interior wall of said cylindrical body angled upwardly from the horizontal.

5. The system of claim 4, wherein each of said flat plates extend and cover over at least fifty percent (50%) of the horizontal cross-section of said cylindrical body.

6. The system of claim 4, wherein each of said flat plates have at least one drain hole adjacent to its central connection point of its attachment to said cylindrical body.

7. In a moving tank carrying a liquid load, such as for example a railroad tank car:

a rupture disk assembly for allowing some of the liquid load to escape from the tank before the tank is fractured from the hydraulic hammer action;

a mechanical energy dissipation system for dissipating hydraulic hammer action in the moving tank car, comprising a mechanical device of a relatively small size in comparison to the size of the tank, said device extending down into the interior of the tank and being located in the line of flow of the liquid between the rupture disk of the rupture disk assembly and the liquid load in the tank, said device presenting a series of diverging, energy dissipating impact surfaces to the liquid flow from the tank to the rupture disk, significantly dissipating the hydraulic hammer action of the liquid from the impact of the liquid against the impact surfaces as it flows through said device.

8. The system of claim 7, wherein said device occupies less than and extends into less than about one percent (1%) of the interior volume of the tank.

9. The system of claim 7, wherein said device includes a cylindrical body; and said diverging, impact surfaces comprises:

a series of baffles in succession affixed to and longitudinally spaced along opposite sides of the interior of said cylindrical body, said cylindrical body projecting into the tank car and out of the tank car leading to the rupture disk assembly.

10. The system of claim 9, wherein said baffles are a series of flat plates affixed to the interior wall of said cylindrical body angled upwardly from the horizontal.

11. The system of claim 10, wherein each of said flat plates extend and cover over at least fifty pecent (50%) of the horizontal cross-section of said cylindrical body.

12. The system of claim 10, wherein each of said flat plates have at least one drain hole adjacent to its central connection point of its attachment to said cylindrical body.

* * * * *